United States Patent [19]

Wiener, Jr.

[11] 3,946,511

[45] Mar. 30, 1976

[54] RESILIENT PICTURE FRAME CONSTRUCTION

[76] Inventor: Samuel G. Wiener, Jr., 2 River Lane, Westport, Conn. 06880

[22] Filed: Oct. 23, 1974

[21] Appl. No.: 517,082

[52] U.S. Cl. ..... 40/152.1

[51] Int. Cl.[2] ..... G09F 1/12

[58] Field of Search ..... 40/152, 152.1, 156, 10

[56] References Cited

UNITED STATES PATENTS

| | | | |
|---|---|---|---|
| 2,276,776 | 3/1942 | Hofmann | 40/152.1 X |
| 2,777,232 | 1/1957 | Kulicke et al. | 40/155 |
| 3,218,747 | 11/1965 | Cornfield | 40/152.1 |
| 3,471,959 | 10/1969 | Seger | 40/152.1 |
| 3,789,527 | 2/1974 | Mohr | 40/152 |

FOREIGN PATENTS OR APPLICATIONS

| | | | |
|---|---|---|---|
| 121,331 | 4/1948 | Sweden | 40/156 |

*Primary Examiner*—Louis G. Mancene
*Assistant Examiner*—Wenceslao J. Contreras
*Attorney, Agent, or Firm*—Charles E. Temko

[57] ABSTRACT

A resilient picture framing construction preferably formed from synthetic resinous materials in which elongated peripheral elements are provided with longitudinal clamping members between which the front and rear panels supporting a photograph or print are resiliently compressed. The peripheral elements are interconnected at the ends thereof by clips to form a rectangular frame, and are so configured that the device may be assembled without the use of tools.

1 Claim, 8 Drawing Figures

FIG. 1
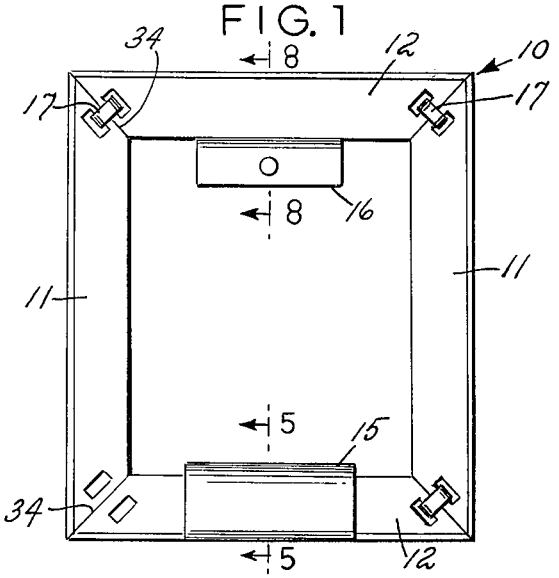
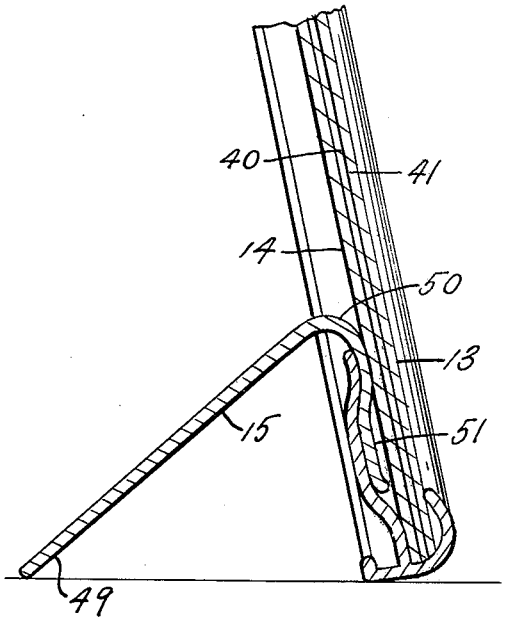
FIG. 5
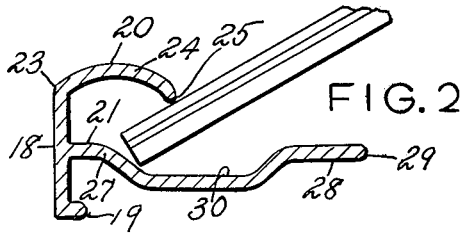
FIG. 2
FIG. 3
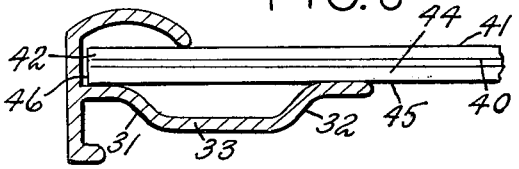
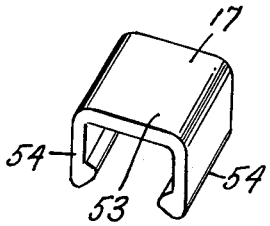
FIG. 6
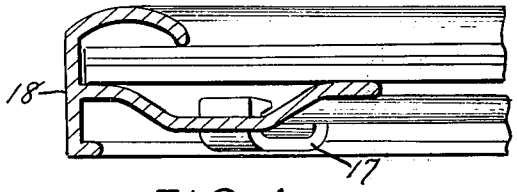
FIG. 4
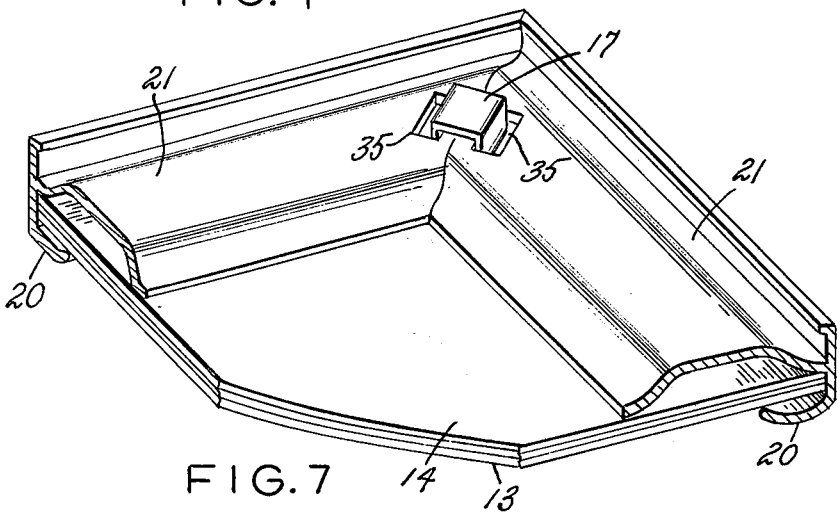
FIG. 7
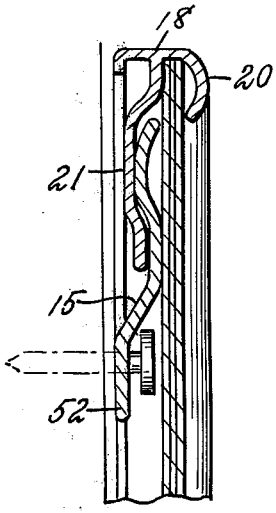
FIG. 8

RESILIENT PICTURE FRAME CONSTRUCTION

BACKGROUND OF THE INVENTION

This invention relates generally to the field of picture frames, and more particularly to those which may be purchased in knocked-down or unassembled form for assembly by a user having only ordinary skills. Devices of this general type are known in the art, and the invention lies in specific constructional details permitting low cost of manufacture, ease of assembly, while affording an attractive appearance.

Most prior art devices include a pre-assembled rectangular frame into which a rigid transparant panel and a rear panel of congruent configuration are fitted to be retained thereby by various means. Such constructions require substantial shelf space prior to sale and use, and make difficult the provision of other than relatively stock frame sizes and configurations.

SUMMARY OF THE INVENTION

Briefly stated, the invention contemplates the provision of a user-assembled frame construction in which the peripheral elements thereof are of extruded synthetic resinous material, and include axially oriented clamping means between which the usual front and back panels are resiliently clamped together as a result of manual insertion of the edge portions of the latter into the former. The peripheral elements are provided with mitred ends which are abutted to form a rectangularly-shaped frame, and interconnected by resilient clips engaging openings in each of said ends. The resilient clamping means may also support a foot or stand, enabling the assembled device to be supported in erect condition upon a horizontal surface, or, in the alternative, a hanger enabling the device to be hung from a wall or other vertical surface.

BRIEF DESCRIPTION OF THE DRAWINGS

In the drawings, to which reference will be made in the specification, similar reference characters have been employed to designate corresponding parts throughout the several views.

FIG. 1 is a rear elevational view of an embodiment of the invention.

FIG. 2 is a sectional view of a frame element comprising a part of the embodiment, and showing a first step in the assembly of the device.

FIG. 3 is a similar sectional view of a frame element showing a second step in the assembly.

FIG. 4 is a similar sectional view showing a third and final step in the assembly of the device.

FIG. 5 is a sectional view as seen from the plane 5—5 in FIG. 1.

FIG. 6 is a perspective view of a frame element interconnecting clip forming a part of the embodiment.

FIG. 7 is a fragmentary perspective view of the embodiment.

FIG. 8 is a sectional view as seen from the plane 8—8 in FIG. 1.

DETAILED DESCRIPTION OF THE DISCLOSED EMBODIMENT

In accordance with the invention, the device, generally indicated by reference character 10, comprises broadly: a first plurality of peripheral frame elements 11, a second plurality of peripheral frame elements 12, a transparent front panel 13, a rear panel 14, a stand or foot element 15, a hanger element 16, and a plurality of interconnecting clips 17.

The frame elements 11 and 12 are substantially similar, differing only in effective length dependent upon the particular format desired. Each element is preferably formed from a continuous synthetic resinous extrusion, and includes a longitudinal main wall 18 having a rearwardly facing flange 19, a first resilient member 20 and a second resilient member 21. The member 20 is bounded by an outer edge 23, a curvilinear medially positioned portion 24 and a rearwardly inturned inner edge 25. The second resilient member 21 includes a first planar portion 27, a second planar portion 28 having an inner edge 29, and a recess-forming portion 30, the portion 30 including a pair of walls 31 and 32 bordering a planar medially disposed wall 33. Each element 11-12 terminates in mitred end edges 34 permitting the same to be placed in abutted relation to define a rectangular opening therebetween. In such relation, angularly disposed slots 35 are aligned to be subsequently engaged by a clip 17.

The transparent panel 13 may be of conventional glass or synthetic resinous construction, and is bounded by an inner surface 40, an outer surface 41, and peripheral edges 42. The rear panel 14 may be of cardboard, wood or pressed paper, and it is of congruent configuration relative to the front panel 13. It is bounded by an inner surface 44, an outer surface 45 and peripheral edge 46. A print or picture (not shown) is normally placed between the panels 13 and 14 in well known manner.

The foot element 15 is optional, depending upon the position of the display of the device, and may be formed as an integral synthetic resinous molding including a strut portion 49, and arcuate portion 50 and a frame engaging portion 51. The element 16 may be similarly formed, and is modified to form a nail engaging portion 52 in lieu of the strut portion 49.

The clips 17 may also be formed by transversely cutting a continuous synthetic resinous extrusion, each clip including a bridging wall 53 and a pair of hooked side walls 54 spaced apart a distance corresponding to a pair of abutted slots 35.

Assembly of the device is a relatively simple procedure. The desired print is placed between the front and rear panels 13 and 14, and shown in FIG. 2 an edge of the superimposed panels is inserted into the interstice between the resilient members 20 and 21 of an element 11, this procedure being facilitated by the space provided by the recess-forming portion 30. The relative movement of the panels 13–14 within the interstice formed by the members 20 and 21 permits the final alignment shown in FIG. 3, following which the remaining elements 11 are similarly engaged as shown in FIG. 1. Either or both of the elements 15 and 16 may be positioned at the time of such engagement so that they are resiliently clamped as shown in FIGS. 5 and 8 at the same time.

This operation will bring all of the frame elements 11 and 12 into coplanar relation, at which time they are interconnected by the positioning of the clips 17 within the juxtaposed slots 35 completing the assembly. It will be noted that normally no tools are required during this procedure.

Should disassembly be required, the clip 17 can normally be dislodged by inserting a fingernail tip beneath the bridging wall 53 of each of the clips 17, permitting each of the elements 11 and 12 to be pulled from engagement with the panels 13–14.

It will be understood by those skilled in the art that the clips 17 may be substituted by short strips of adhesive tape, thus permitting any of the elements 11–12 to be cut to non-standard relative sizes, where required.

I wish it to be understood that I do not consider the invention limited to the precise details of structure shown and set forth in this specification, for obvious modifications will occur to those skilled in the art to which the invention pertains.

I claim:

1. In a picture frame construction including a plurality of interconnected peripheral frame elements, each frame element defining a longitudinally oriented resilient clamping means, at least one planar panel having edge portions thereof positioned between said clamping means of each of said plurality of frame elements to thereby maintain said frame elements in mutually coplanar relation, the improvement comprising: said clamping means including a longitudinal main wall, and first and second oppositely disposed resilient members; said first resilient member being of curvilinear cross section, and having a free edge facing said second resilient member; said second resilient member including a first planar portion, a second planar portion in co-planar relationship relative to said first planar portion, and a recess-forming portion disposed between said first and second planar portions and opposite said free edge of said first resilient member; whereby engagement of said clamping means with said planar panel is facilitated by the insertion of an edge of said panel into said recess-forming portion at an angle relative to the plane of said first and second planar portions of said second resilient member, and subsequently aligning and contacting said panel with said first and second planar portions on one surface of said panel, while contacting said free edge of said first resilient member on another surface of said panel.

* * * * *